US005778811A

United States Patent [19]

Gill et al.

[11] Patent Number: 5,778,811

[45] Date of Patent: Jul. 14, 1998

[54] SEWING MACHINE

[75] Inventors: Peter Gill; Jason Prout, both of Leeds, England

[73] Assignee: AMF Reece, Inc., Richmond, Va.

[21] Appl. No.: 672,227

[22] Filed: Jul. 5, 1996

[30] Foreign Application Priority Data

Jul. 8, 1995 [GB] United Kingdom ..... 9513978

[51] Int. Cl.[6] ..... D05B 21/00

[52] U.S. Cl. ..... 112/470.09; 112/470.18; 112/148

[58] Field of Search ..... 112/470.07, 470.09, 112/470.14, 470.18, 308, 309, 153, 102, 103, 148

[56] References Cited

U.S. PATENT DOCUMENTS 4,010,701 3/1977 Helfont ..... 112/148

4,982,675 1/1991 Taguchi et al. ..... 112/103 X

*Primary Examiner*—Peter Nerbun

*Attorney, Agent, or Firm*—Madson & Metcalf

[57] ABSTRACT

A sewing machine for use with a template capable of holding together two or more layers of fabric that are to be stitched together, the template having a groove shaped according to the required stitching profile and engageable with a guide member projecting upwardly from a baseplate of the sewing machine, the guide member having a hole through which a needle mounted on the sewing machine passes to effect a stitching action, the template further comprising relatively movable sections for forming at least one pleat in an upper layer of fabric and so imparting fullness to that layer as the sections are moved together, the end of the pleat extending across the groove. The machine includes diverting means for engaging the pleat, the diverting means being secured in a fixed position on the sewing machine head to lie above the guide member. The diverting means has a needle passage aligned with the needle passage hole through the guide member. The machine includes drive means for effecting movement of the template relative to the guide member to drive the template so that the groove moves along the guide member. The drive means comprises a drive wheel having a periphery capable of engaging a drive edge of the template, means for rotating the drive wheel to cause this to move the template in a normal direction, and means for reversing the direction of rotation of the drive wheel to cause this to move the template in a reverse direction.

7 Claims, 7 Drawing Sheets

SEWING MACHINE

This invention relates to a sewing machine, and particularly to a sewing machine for use with a template capable of holding together two or more layers of fabric that are to be stitched together along a defined stitching profile.

Machines of this type are known, having a guide member that projects upwardly from a baseplate of the sewing machine and engages into a groove formed in the lower surface of the template, the groove being shaped according to the stitching profile. The guide member has a needle passage hole and the machine includes drive means for driving the template relative to the machine so that the groove moves along the guide member. The needle thus stitches along the length of the groove to effect the required connection. The template comprises two or more hinged plates between which fabric layers are placed in the desired relationship, with edges of the layers overlying the groove so that the layers are stitched together along the line of the groove as the template moves relative to the baseplate.

One particular use of this technology is in the set-back tipping of neckties. GB-A-2110256 describes a template that may be used for this, the template having a lower plate, an intermediate plate and an upper plate, together with ribs that impart fullness to different layers of fabric laid between the plates as the plates are closed together. The ribs have the effect of forming pleats in an upper fabric layer and these pleats extend beyond the ribs to overlie the groove in the same way as do the edges of the fabric. It is important that such pleats are not stitched down to other parts of the fabric and to this end means are provided for diverting the pleat from the path of the needle as a section of the groove overlain by the pleat approaches the guide member. As described in GB-A-2110256 diversion of the pleat is effected by a pleat wiper mounted on the sewing machine head and movable to and fro to engage and move the pleat. The present invention seeks to provide a simpler form of pleat diverter, avoiding the mounting of moving parts on the sewing machine head.

A sewing machine for use with a template capable of holding together two or more layers of fabric that are to be stitched together and comprising:

- a groove formed in the template and shaped according to the required stitching profile;
- a sewing machine base plate having a guide member projecting upwardly therefrom to engage with said groove;
- a hole formed in the guide member;
- a needle mounted on the sewing machine and operative to pass through said hole in the guide member to effect a stitching action;
- relatively moveable sections forming part of said template and operative to form at least one pleat in an upper layer of fabric and thereby to impart fullness to that layer as the sections are moved together, with the end of the pleat extending across said groove;
- diverting means for engaging said pleat and secured in a fixed position on a head of the sewing machine to lie above the guide member, said diverting means having a needle hole formed in said guide member;
- drive means for effecting movement of the template relative to the guide member to drive the template so that the groove is moveable along the guide member, said drive means comprising a drive wheel having a periphery capable of engaging a drive edge of the template;

- means for rotating the drive wheel to cause the latter to move the template in a normal direction; and
- means for reversing the direction of rotation of the drive wheel to cause the latter to move the template in a reversed direction.

In operation, the template is driven in the normal direction with stitching being effected by the needle. As the pleat approaches the needle the pleat is engaged by the diverting means and is moved out of the needle path so that stitching of the pleat is avoided. Stitching is suspended and the template is driven further to move the pleat completely past and clear of the needle. The drive direction is then reversed and the template is driven backwards, the pleat being diverted in the opposite direction until the required stitching re-start point is reached. Drive in the forward direction then recommences, the needle operating to stitch along the next section of the groove. Diversion of the pleat is thus effected by a fixed member on the sewing machine head, with a simple drive reversal, allowing resumption of stitching at the required point.

Preferably a line between the center of the needle passage hole through the guide member and the point of engagement between the drive wheel and the template is substantially at right angles to the direction of travel of the groove past the guide member. Depending on the shape of the guide member and the configuration of the groove it is possible that reversal of the drive to the template may effect some pivotal movement of the template about the guide member. There may then be a danger of the template binding on the guide member due to the resulting misalignment. Desirably, therefore, correcting means are mounted on the base plate of the sewing machine for engaging the template to effect pivotal movement of the template about the guide member in a sense opposite to the sense of pivotal movement caused by reversal of the drive wheel, and limit means are provided for limiting the degree of pivotal movement effected by the correcting means.

Thus, any misalignment may be corrected by operation of the correcting means, an over-correction being prevented by the limit means.

The correcting means preferably comprises pusher means mounted for movement from the drive wheel side of the guide member towards the template position along a line substantially parallel to the line between the centre of the needle passage hole and the point of engagement between the drive wheel and the template. The pusher means is conveniently movable between a normally retracted position and a pushing position by a pneumatic ram mounted on the base plate of the machine. The limit means may desirably be stop means spring biased towards the template from the drive wheel side of the guide member, preferably along a line substantially parallel to the line between the center of the needle passage hole and the point of engagement between the drive wheel and the template.

In order that the invention may be better understood a specific embodiment of a sewing machine in accordance therewith will now be described in more detail, by way of example only, with reference to the accompanying drawings in which.

Figure 1:
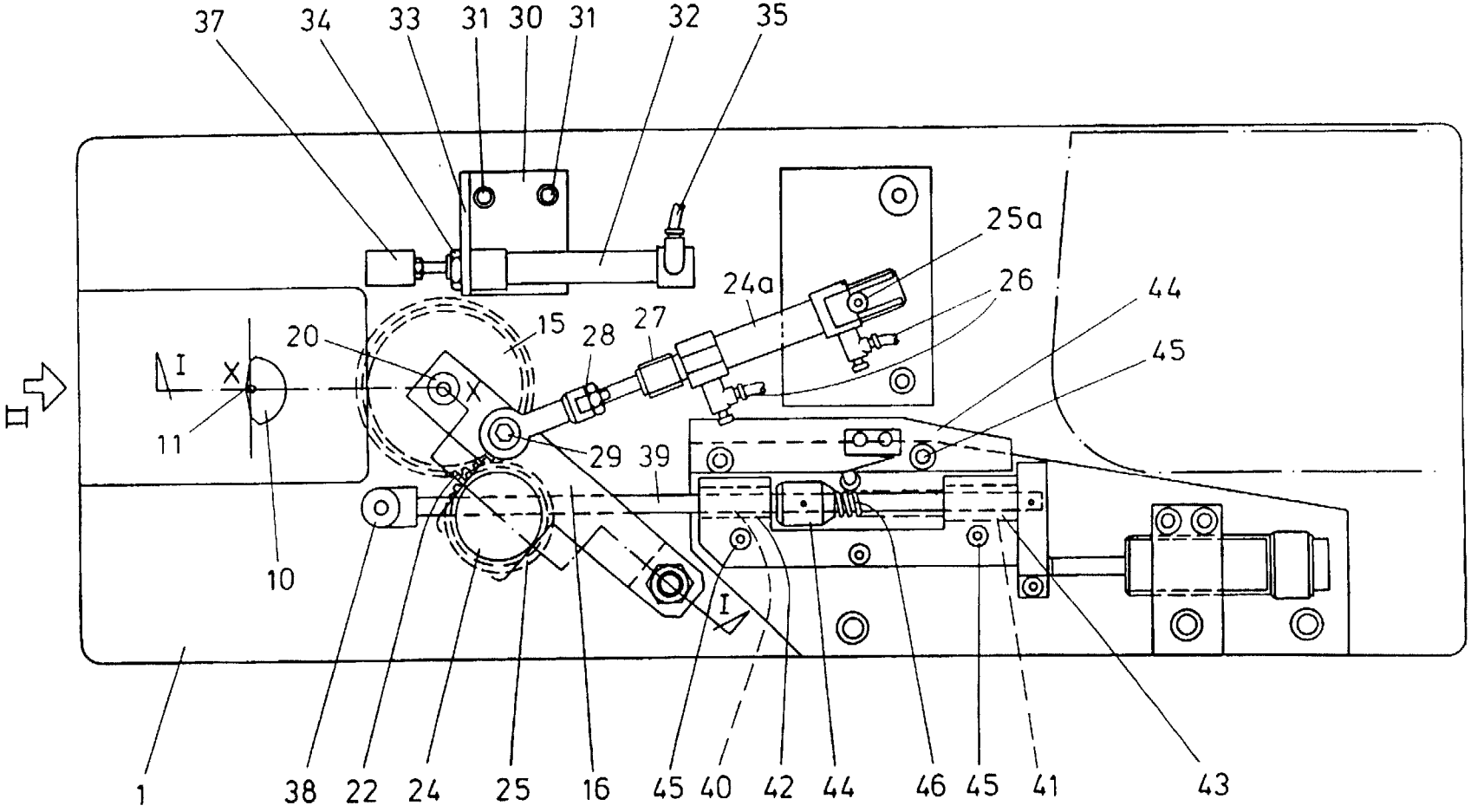
FIG. 1 is a plan view of part of a sewing machine.
Figure 2:
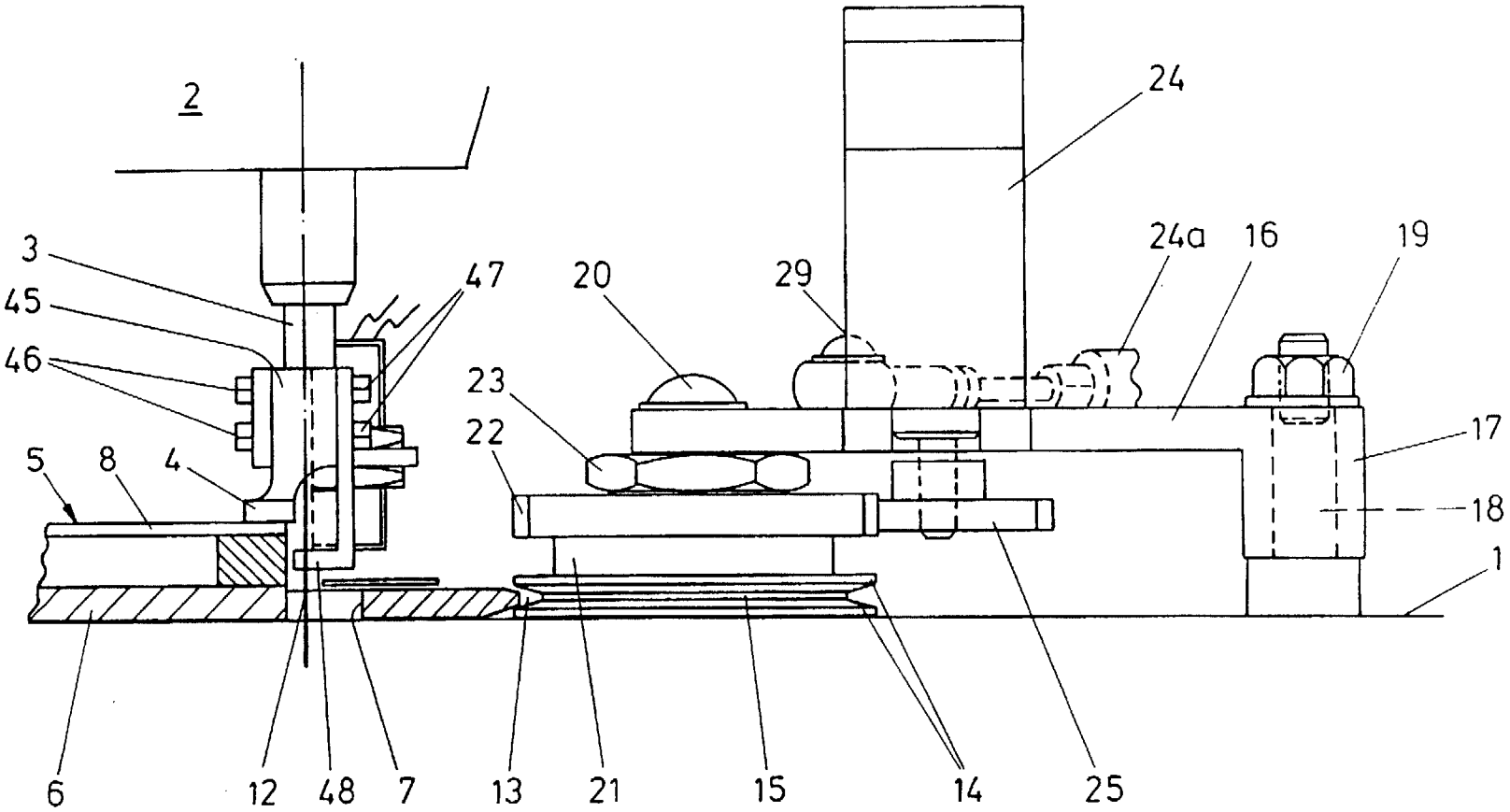
FIG. 2 is a section on the line I—I of FIG. 1.
Figure 3:
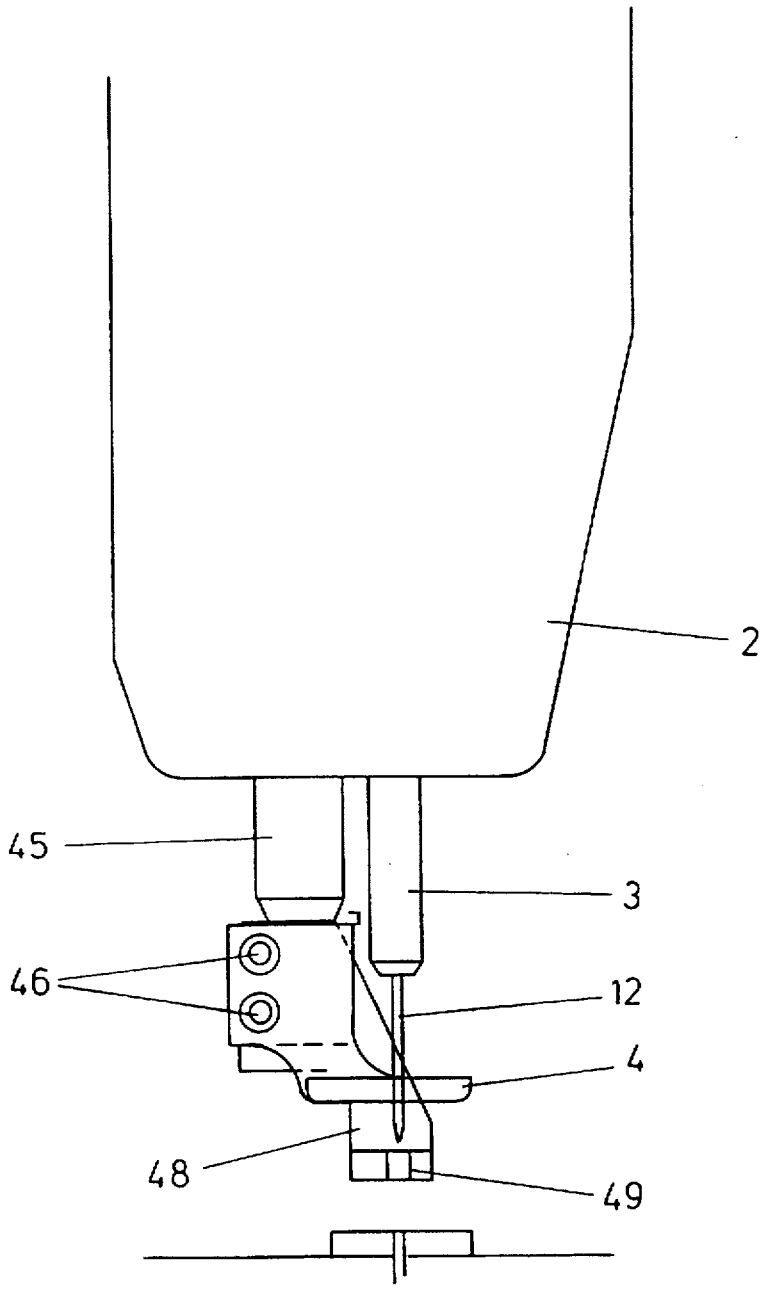
FIG. 3 is an end elevation in the direction of arrow II of FIG. 1.

FIGS. 1 to 3 show part of the upper surface of a baseplate 1 of a sewing machine which has a head 2 including a section depending towards the baseplate and enclosing a needle drive mechanism capable of vertically reciprocating a needle holder 3. A presser toot 4 for bearing on the upper surface of a template 5 also extends downwardly from the head 2.

The template comprises a lower plate 6, in which is formed a groove 7 shaped according to the required stitching profile, and one or more upper plates such as 8. One or more layers of fabric to be stitched are held between the plates, with edges of the fabric layers overlapping the groove 7. The plates are designed to impart fullness to individual fabric layers as they are loaded into the template, as is well known in this field. Although not so limited, the apparatus of the invention is particularly suited to the set-back tipping of neckties, and a template suitable for this purpose is described in GB-A-2110256, the entire contents of which are herein incorporated by reference. Such a template imparts fullness by forming one or more pleats in an upper layer of fabric, and the or each such pleat has a free end which extends across the groove 7, as indicated for pleat 9 in FIG. 4A.

The sewing machine has a guide member 10 projecting upwardly from the baseplate 1, and in use the groove 8 is located over the guide member with the lower surface of the template resting on the baseplate and held in engagement therewith by the presser foot 4. The guide member is formed with a needle passage hole 11 through which a needle 12 mounted on the needle holder 3 may pass during the stitching action.

In order to stitch along the required line the template must be driven relative to the baseplate so that the groove 8 moves over the guide member 10. To this end the edge 13 of the template is shaped so as to be engaged between opposed tapering flanges 14 of a drive wheel 15. The materials are such as to present a high coefficient of friction so that rotation of the drive wheel about its axis will effect longitudinal drive of the template.

A support arm 16 has a transverse boss 17 at one end thereof and is pivotally mounted on the baseplate by engagement of the boss around an upstanding pivot pin 18, having a threaded upper end with which a locknut 19 is engaged. The opposite end of the support arm 16 has a depending bearing pin secured thereto by a screw 20. The bearing pin rotatably supports a sleeve formed integrally, with, and coaxially upstanding from, the drive wheel 15. The sleeve carries a spacer 21 and a pinion 22 secured in position by a locknut 23.

A direct current electric motor 24 is also carried on the support arm 16, and is mounted thereon with its axis parallel to the axis of the drive wheel 15. The motor is reversible. The output shaft of the motor has a pinion 25 secured thereon, the pinion 25 being in permanent engagement with the pinion 22. Power to the motor is supplied through electrical leads (not shown) and drive and reverse control signals are transmitted to the motor through further leads (again not shown).

The support arm 16 is biased in the general direction towards the guide member 10 by a pneumatic ram 24*a* having a cylinder pivotally mounted on the baseplate about an axis 25*a* and fed with compressed air through hoses 26. The piston of the ram is connected to a rod 27, provided with a length adjuster 28 the free end of which is pivotally secured to the support arm about an axis 29.

Situated to the downstream side of the drive wheel 15 (relative to the normal direction of travel of the template) is a support 30 secured to the baseplate by bolts 31. A single acting pneumatic ram 32 has its cylinder secured to an upstanding flange 33 of the support by a nut 34, the ram being supplied with compressed air through a hose 35. The piston of the ram is biased to its retracted position (as shown in FIG. 1) by an internal spring and can be extended to the left as seen in this Figure by admission of air into the cylinder of the ram 32. The piston rod 36 carries a pusher element 37 at its free end. The axis of this ram is parallel to the line X—X between the center of the needle passage hole 11 and the point of engagement between the drive wheel and the edge of the template.

On the upstream side of the drive wheel 15 (relative to the normal direction of travel of the template) is a limit member 38 carried at the end of a rod 39. The rod passes through spaced guide tubes 40, 41 formed in flanges 42, 43 upstanding from a support 44 secured by bolts 45 to the baseplate. The rod is biased in the general direction of the guide member by a compression spring 46 surrounding the rod between flange 43 and a stop 44 secured to the rod and engageable with the flange 42. The axis of the rod 39 is also parallel to the line X—X between the center of the needle passage hole 11 and the point of engagement between the drive wheel and the edge of the template.

As has already been stated, the presser foot 4 bears on the upper surface of the template 5. The presser foot is secured to a carrier 45 by bolts 46, and the carrier is capable of being raised and lowered relative to the sewing machine head in conventional manner. The carrier 45 also has secured thereto by bolts 47 a pleat diverter 48. As is evident from FIG. 2 the pleat diverter lies directly above the guide member 10, and the diverter is formed with a slot 49 through which the needle of the sewing machine passes.

In operation, when the template is properly positioned with the start of the groove 8 engaged over the guide member 10, the presser foot is lowered into the position shown in FIG. 2 and the piston rod 27 of the ram 24 is extended so as to bias the periphery of the drive wheel 15 into engagement with the edge 13 of the template. The pusher element is in its retracted position as shown in FIG. 2 and the edge of the template bears against the limit member 38 in advance of the point of engagement with the drive wheel. The motor is actuated to drive the drive wheel in its normal direction of rotation and hence to drive the template in its normal direction D, the groove moving over the guide member and the needle being operated so as stitch the fabric layers together, the needle reciprocating through the slot 49 in the pleat diverter 48 and the hole 15 in the guide member 10. Control of the ram 24 is such that the drive wheel is permitted to yield slightly away from the guide member in a direction transverse to the direction D as will be required, for example, when curved track sections move into engagement with the guide member.

Figure 4A:
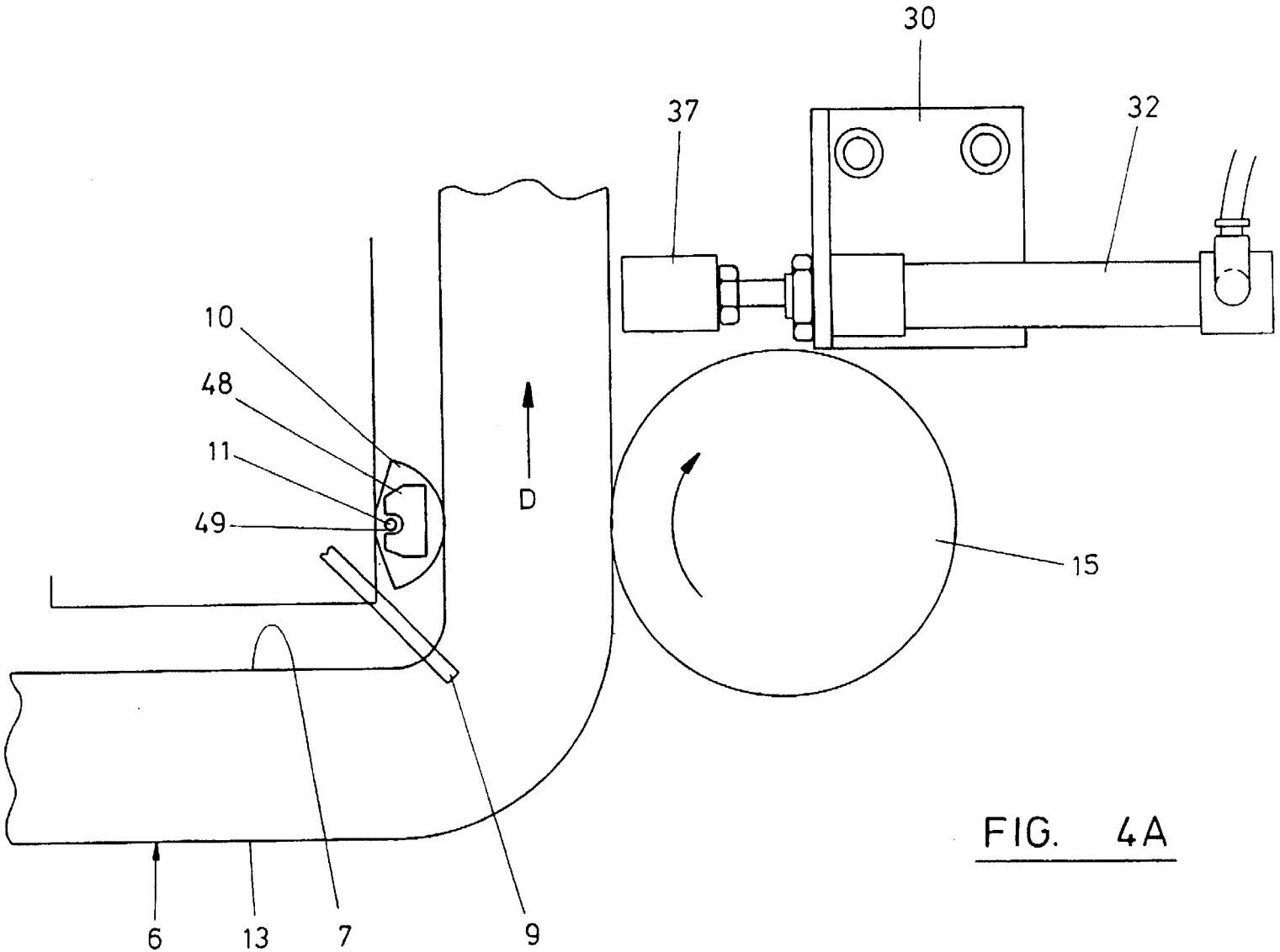
FIGS. 4A to 4D are detail views of parts of FIG. 1 during successive stages of a pleat diverting operation.
Figure 4B:
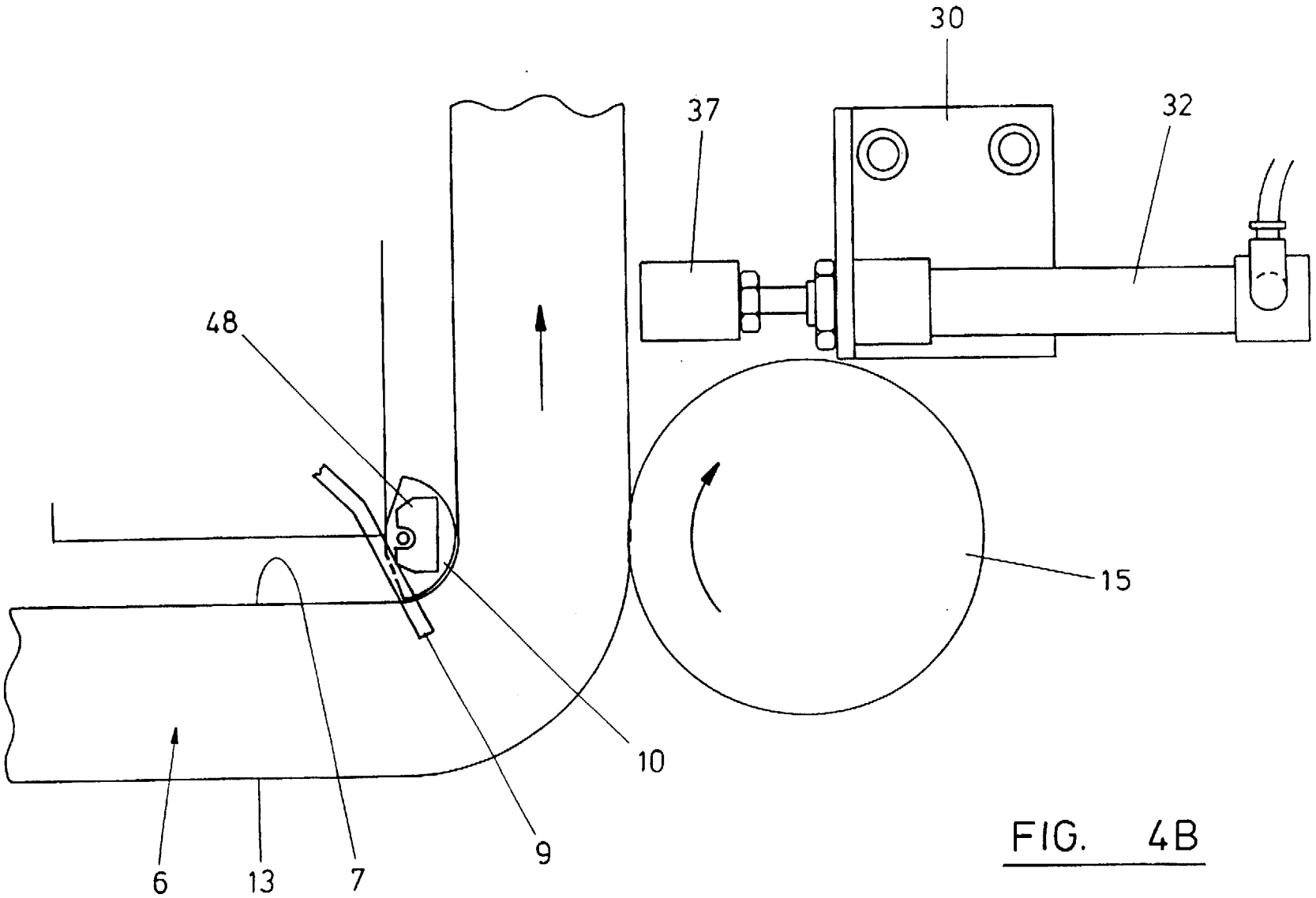
Figure 4C:
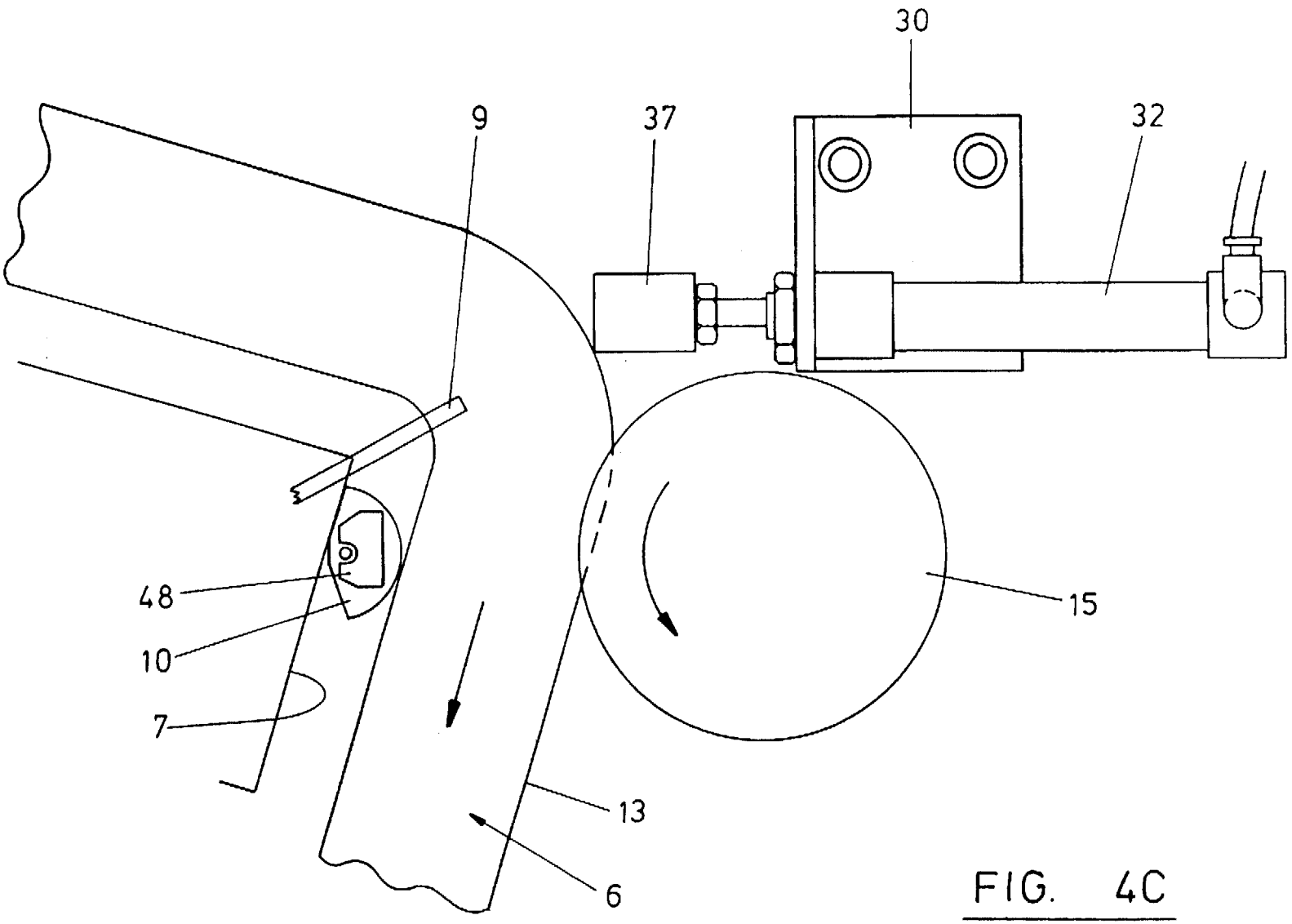

FIG. 4A shows the situation as a curved corner section of the groove 8 in the template approaches the needle, a section of pleat 9 extending across the groove at the corner section. Tie pleat diverter 48 engages the pleat and moves this out of the path of the needle, stitching continuing into the corner of the groove as shown in FIG. 4B. The needle is then stopped, but the drive to the template is continued, causing the corner to be turned and the template to be moved on past the corner. As the pleat moves clear of the diverter it returns to its position lying across the corner of the groove. Stitching mist be resumed at substantially the point at which it was discontinued. Accordingly, the motor is reversed to drive the template back from the position shown in FIG. 4C to that shown in solid lines in FIG. 4D. During this movement the diverter engages the pleat to divert this in the opposite direction and again move it clear of the needle.

Figure 4D:
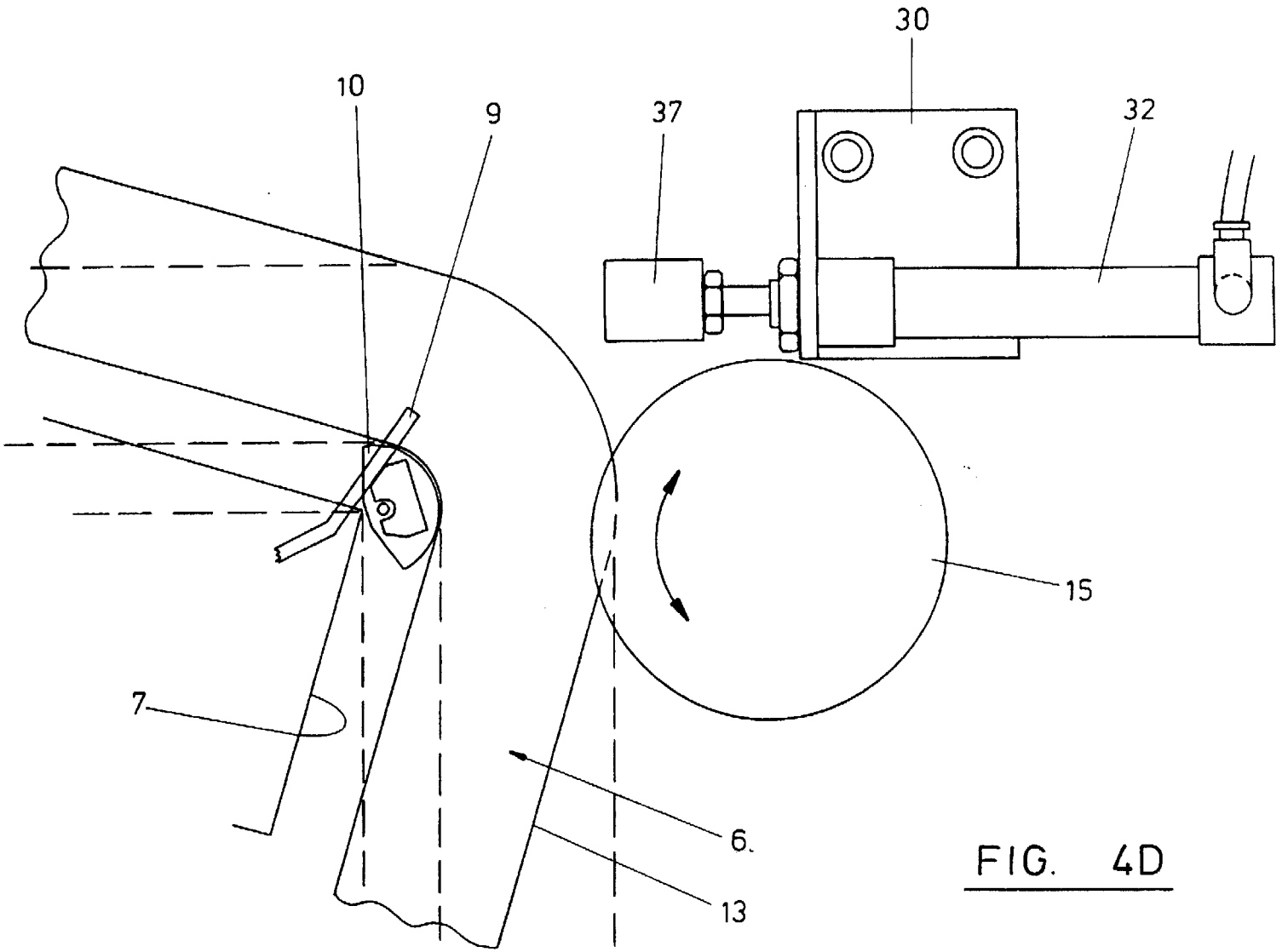

Application of the reverse drive to the template causes this to pivot about the guide member and to skew into the position shown in FIG. 4D. This may have the effect of causing the template to jam against the face 50 of the guide member so that when forward drive is resumed the template will be jammed and the drive will slip. In order to prevent this happening the ram 32 is operated to extend the pusher element 37 so pivoting the template in the opposite sense around the guide member until the template engages the limit member 38. The template is now back in proper alignment as shown in broken lines in FIG. 4D, the pleat is diverted from the needle and both stitching and forward drive of the template can be resumed.

It will be understood that modifications may be made to the apparatus as specifically described. Thus, the pusher member need not be pneumatically actuated and situated to the downstream side of the guide member. Any form of pusher member may be used so long as it is located and operable to apply to the template a turning moment about the guide member that will correct the pivotal movement caused by reversal of the motor. Similarly, the stop member need not be located as shown, as long as it has the effect of stopping pivotal movement of the template once the correct alignment has been achieved. Other modifications will be apparent to those skilled in the art.

We claim:

1. A sewing machine including a template capable of holding together two or more layers of fabric that are to be stitched together and comprising:

a groove formed in the template and shaped, according to a required stitching profile;

a sewing machine base plate having a guide member projecting upwardly therefrom to engage with said groove;

a needle hole formed in the guide member;

a needle mounted on the sewing machine and operative to pass through said hole in the guide member to effect a stitching action;

relatively moveable sections forming part of said template and operative to form at least one pleat in an upper layer of fabric and thereby to impart fullness to that layer as the sections are moved together, with the end of the pleat extending across said groove;

diverting means for engaging said pleat and secured in a fixed position on a head of the sewing machine to lie above the guide member, said diverting means having a slot formed therein;

drive means for effecting movement of the template relative to the guide member to drive the template so that the groove is moveable along the guide member, said drive means comprising a drive wheel having a periphery for engaging a drive edge of the template;

means for rotating the drive wheel to cause the latter to move the template in a normal direction; and means for reversing the direction of rotation of the drive wheel to cause the latter to move the template in a reversed direction.

2. A sewing machine according to claim 1, in which a line between the center of the needle hole in the guide member and the point of engagement between the drive wheel and the template is substantially at right angles to the direction of travel of the groove past the guide member.

3. A sewing machine according to claim 1, including correcting means mounted on the base plate of the sewing machine for engaging the template to effect pivotal movement of the template about the guide member in a sense opposite to the sense of pivotal movement caused by reversal of the drive wheel, and limit means for limiting the degree of pivotal movement effected by the correcting means.

4. A sewing machine according to claim 3, in which the correcting means comprises pusher means mounted for movement from the drive wheel side of the guide member towards the template position along a line substantially parallel between the center of the needle hole and the point of engagement between the drive wheel and the template.

5. A sewing machine according to claim 4, in which the pusher means is moveable between a normally retracted position and a pushing position by a pneumatic ram mounted on the base plate of the machine.

6. A sewing machine according to claim 4, in which said limit means comprises stop means spring biassed towards the template from the drive wheel side of the guide member.

7. A sewing machine according to claim 6, in which the spring biassed stop means acts along a line substantially parallel to the line between the center of the needle hole and the point of engagement between the drive wheel and the template.

* * * * *

UNITED STATES PATENT AND TRADEMARK OFFICE

CERTIFICATE OF CORRECTION

PATENT NO. : 5,778,811
DATED : July 14, 1998
INVENTOR(S) : Peter Gill et al.

It is certified that error appears in the above-identified patent and that said Letters Patent is hereby corrected as shown below:

In column 3, line 3, delete "toot", and insert therefor -- foot --.
In column 4, line 55, delete "Tie" and insert therefor -- The --.

Signed and Sealed this

Twenty-second Day of September, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRRECTION

PATENT NO. : 5,778,811
DATED : July 14, 1998
INVENTOR(S) : Peter Gill et al.

It is certified that error appears in the above-identified patent and that said Letters Patent is hereby corrected as shown below:

On the title page, item [56] insert the following

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 2 | 1 | 3 | 9 | 2 | 5 | 4A | 11/7/84 | United Kingdom | | | | |
| | | 2 | 1 | 1 | 0 | 2 | 5 | 6A | 6/15/83 | United Kingdom | | | | |
| | | 2 | 0 | 6 | 2 | 7 | 0 | 8A | 5/28/81 | United Kingdom | | | | |
| | | | | | | | | | | | | | | |

Signed and Sealed this

Ninth Day of March, 1999

*Attest:*

Q. TODD DICKINSON

*Attesting Officer*

*Acting Commissioner of Patents and Trademarks*